United States Patent [19]

Dean

[11] 3,955,838

[45] May 11, 1976

[54] DOOR LOCK

[76] Inventor: Charles Dean, 118 Reid, Vaudreuil, Quebec, Canada

[22] Filed: Mar. 20, 1975

[21] Appl. No.: 560,490

[52] U.S. Cl. ..... 292/179; 292/169.13; 292/174

[51] Int. Cl.[2] ..... E05C 1/02

[58] Field of Search ..... 292/174, 179, 169.13, 292/166, 168; 70/150

[56] References Cited

UNITED STATES PATENTS

| | | | |
|---|---|---|---|
| 3,121,319 | 2/1964 | Webster | 70/150 |
| 3,206,954 | 9/1965 | Snyman | 70/150 |
| 3,768,847 | 10/1973 | Buck | 292/179 |
| 3,891,255 | 6/1975 | Millett | 292/169.13 |

*Primary Examiner*—Robert L. Wolfe
*Attorney, Agent, or Firm*—Diller, Brown, Ramik & Wight

[57] ABSTRACT

A door latch mechanism which is actuated by pushing or pulling on a handle in order to disengage the latch bolt mechanism from a strike, thereby avoiding the necessity of having to rotate a knob or handle. The door latch mechanism according to the subject invention is of simple construction and is therefore economical to produce. The mechanism includes a primary latch bolt mechanism slidably mounted within a housing having an open end. The mechanism includes a head portion situated at the open end of the housing and having a bevelled surface, and an integral tail portion. An auxiliary bolt is slidably mounted within the housing adjacent the head portion, the forward portion of the auxiliary bolt likewise projecting through the open end of the housing. The forward portion of the auxiliary bolt is adapted to be urged rearwardly upon rearward movement of the head portion of the primary latch bolt mechanism. A block member is slidably mounted within the housing and a first compression member engages the block member and auxiliary bolt. A second compression member engages the tail portion of the latch bolt mechanism and a projection means rigidly mounted within the housing. The second compression member biases the head portion out of the open end of the housing, while biasing the tail portion against the block member. A stop member is mounted within the housing on a transverse shaft, the latter having a handle supported thereon exterior to the housing so as to disengage the stop member from the block member. Upon this disengagement, the block member and the tail portion of the latch bolt mechanism are urged rearwardly by the first compression member thereby disengaging the head portion of the door latch mechanism from a cooperating opening in a strike.

9 Claims, 12 Drawing Figures

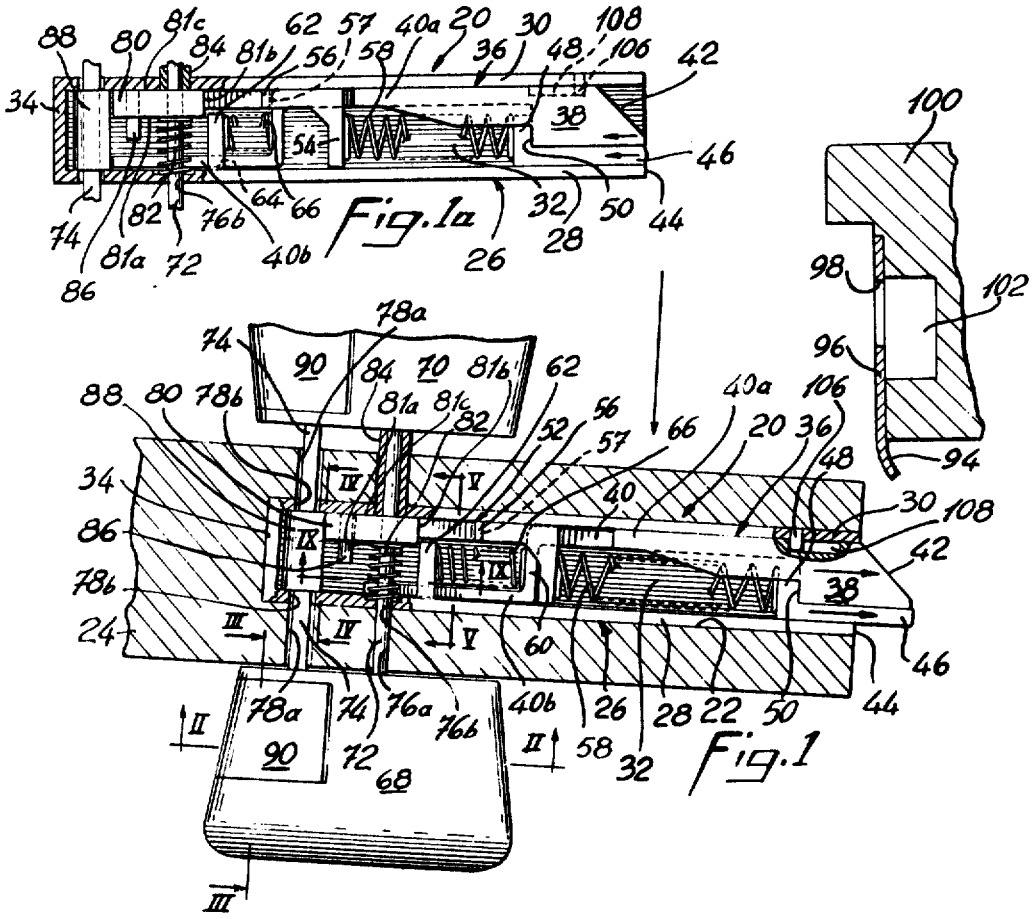
Fig. 1a
Fig. 1
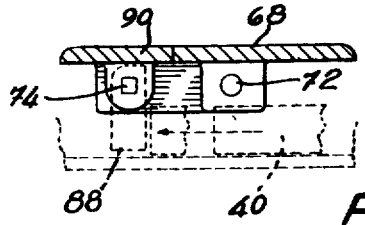
Fig. 2
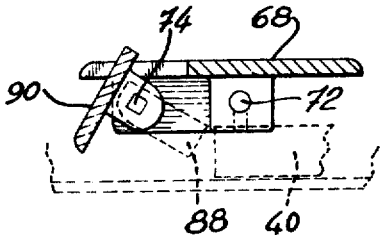
Fig. 2a
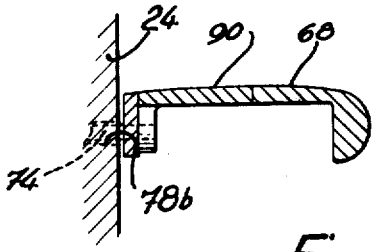
Fig. 3

DOOR LOCK

BACKGROUND OF THE INVENTION

1. Field of the Invention

This invention relates generally to a door latch mechanism and, in particular, to such a mechanism which is actuated by pulling or pushing, as opposed to rotating, a door knob or handle.

2. Description of the Prior Art

Known door latch mechanisms utilize an outer knob or handle which is rotated either clockwise or counterclockwise in order to disengage a latch bolt mechanism from a strike. However, in certain instances, the use of a rotatable knob or handle is not feasible, and an alternative form of latch actuator mechanism must be found. For example, in cases where the person had limited or no use of their hands, rotation of a knob or handle becomes quite difficult, if not impossible. Likewise, young children may not have sufficient strength nor have hands which are large enough to grip and rotate a door knob or handle. The proposed invention proposes to provide a door latch assembly which can be actuated by pulling or pushing on a handle in order to disengage the latch bolt from the strike, thereby avoiding the necessity of having to rotate a knob or handle.

The door latch mechanism according to the present invention is of extremely simple construction, utilizing few and relatively inexpensive parts, such that the mechanism is economical to produce. It is presently contemplated that the door latch mechanism according to the present invention would be primarily utilized on interior doors within a building, such as passage doors permitting access to a room or other enclosure by merely pulling or pushing the door handle, depending on which handle is being operated. In addition, the proposed invention provides a simple but effective locking mechanism which can be associated with either one or both door handles, in the case where the assembly utilizes two handles, and can be easily actuated with the application of a minimum amount of force.

SUMMARY OF THE INVENTION

According to the present invention, the door latch mechanism comprises a housing adapted to be mounted in a door, the housing having an open end. A primary latch bolt mechanism is slidably mounted within the housing, the primary latch bolt mechanism having a head portion and an integral tail portion, a forward section of the head portion situated at the open end of the housing projecting outwardly through the open end of the housing and adapted to engage a cooperating opening in a strike. An auxiliary bolt is slidably mounted within the housing at the open end thereof and situated adjacent to and engaging the head portion of the primary latch bolt mechanism, a forward portion of the auxiliary bolt projecting outwardly through the open end of the housing, the forward portion of the auxiliary bolt adapted to be urged rearwardly upon rearward movement of the head portion of the primary latch bolt mechanism. A block member is slidably mounted within the housing and situated rearwardly from the auxiliary bolt and head portion. A first compression member is mounted within the housing and engages the block member and auxiliary bolt so as to bias the auxiliary bolt away from the block member. A second compression member is mounted within the housing, the second compression member engaging the tail portion of the primary latch bolt mechanism and projection means rigidly mounted within the housing. The second compression member biases the forward section of the head portion outwardly through the open end of the housing while biasing the tail portion of the primary latch bolt mechanism against the block member. A stop member is mounted within the housing on a shaft extending transversely through the housing. At least one handle is rigidly mounted on the shaft exterior to the housing, the at least one handle adapted to permit the transverse shaft to be moved in a longitudinal direction thereof, whereby the stop member is advanced out of engagement with the block member. The primary latch bolt mechanism and auxiliary bolt are adapted to be urged rearwardly upon engagement of the forward section of the head portion of the bolt mechanism with a strike, thereby compressing the first and second compression members. A force generated by the first compression member exceeds a force generated by the second compression member, whereby a resultant force is applied to the block member, urging the block member rearwardly into contact with the stop member. The forward section of the head portion engages a cooperating opening in the strike and is projected into the opening by the second compression member while the strike retains the auxiliary bolt within the housing. The at least one handle is adapted to be moved axially whereby the stop member is advanced out of engagement with the block member, and whereby the block member and the tail portion of the latch bolt mechanism are urged rearwardly by the first compression member, thereby disengaging the head portion of the door latch mechanism from the cooperating opening in the strike.

BRIEF DESCRIPTION OF THE DRAWINGS

In drawings which illustrate one embodiment of the present invention;

FIG. 1 is a plan view of the door latch mechanism according to the subject invention mounted in a door before engagement with a strike;

FIG. 1*a* is a plan view of the position of the components forming the door latch mechanism immediately preceding engagement of the head portion with the strike opening;

FIG. 2 is a vertical cross-section of the handle, taken along the line II—II of FIG. 1;

FIG. 2*a* is a vertical cross-section of the handle, similar to that of FIG. 2, but with the lock actuator in its operative position;

FIG. 3 is a vertical cross-section of the handle taken along the line III—III of FIG. 1;

DESCRIPTION OF PREFERRED EMBODIMENTS

Figure 4:
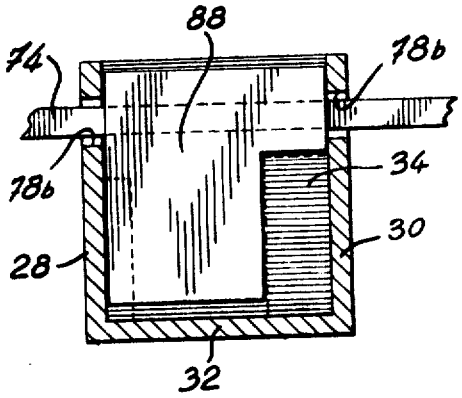
FIG. 4 is a vertical cross-section of the door latch mechanism housing, taken along the line IV—IV of FIG. 1.
Figure 5:
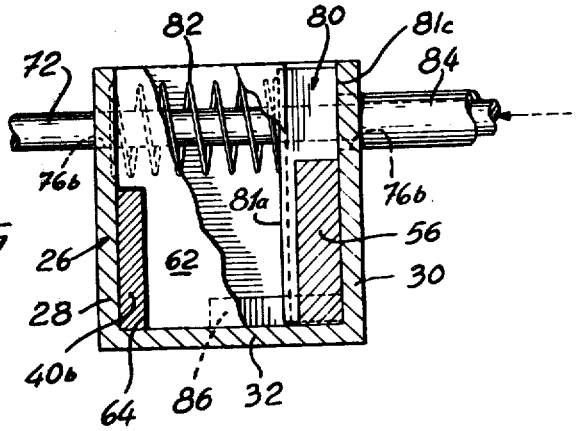
FIG. 5 is a vertical cross-section of the housing of FIG. 1, taken along the line V—V.

In the embodiment of the invention illustrated in the drawings, the door latch mechanism is indicated generally by reference numeral 20, the mechanism being mounted in a longitudinal slot 22 situated in one end of a door 24.

The door latch mechanism includes a housing 26 having longitudinal side walls 28 and 30, a bottom wall 32, a rear end wall 34, and an open front end 44. The outer surfaces of the housing fit snugly against the surfaces of the longitudinal slot 22 located in the door 24 so as to restrict movement of the housing within the slot. Mounted within the housing 26 is a primary latch bolt mechanism 36 having a head portion 38 and a tail portion 40. The head portion 38 includes a section having a flat, bevelled front surface 42 which normally projects outwardly from the open front end 44 of the housing 26, the bevelled surface 42 functioning as a cam upon engagement with a strike, thereby urging the primary latch bolt mechanism 36 rearwardly.

The primary latch bolt mechanism 36 is slidably mounted within the housing 26 and has one longitudinal surface in sliding engagement with an inner surface of side wall 30 of the housing. Situated within the housing 26 adjacent to the primary latch bolt mechanism 36 is an auxiliary bolt 46 which is substantially L-shaped in plan view, the bolt 46 having an inwardly directed end projection 48. The auxiliary bolt 46 lies against one side surface of the head portion 38 of the primary latch bolt mechanism, with the end projection 48 of the auxiliary bolt engaging a step portion 50 of the head portion when the head portion 38 of the door latch mechanism is not in engagement with an opening in a strike.

The door latch mechanism 20 also includes a block member 52, the member 52 being slidably mounted within the housing 26 and situated rearwardly from the head portion 38 and auxiliary bolt 46. The block member 52 is also substantially L-shaped in plan view, having a front leg 54 which extends across the width of the housing 26 and a side leg 56 which slidably engages the inner surface of side wall 30 of the housing and extends rearwardly from the front leg 54. A first compression member comprising a coil spring 58 is situated within the housing 26, with one end bearing against a front face of the front leg 54 of the block member 52 and the opposite end bearing against a rear surface of the end projection 48 of the auxiliary bolt 46. The coil spring 58 biases the auxiliary bolt 46 and lock member 52 away from each other, the force applied by the coil spring increasing as it is compressed.

A rear surface of the front leg 54 of the block member 52 engages a section 60 of the tail portion 40 of the primary latch bolt mechanism 36. A transverse section 60 of the tail portion 40 extends across the width of the housing 26 and is situated to the rear of and adjacent to the front leg 54. Transverse section 60 connects first longitudinal section **40*a* of tail portion 40 with second longitudinal section 40*b*, first longitudinal section 40*a* extending from head portion 38 to transverse section 60 adjacent to side wall 30, and second longitudinal section 40*b* extending rearwardly from transverse section 60 adjacent to side wall 28 of the housing 26. An elongated slot 57 is provided in the block member 52 to permit unobstructed longitudinal movement of the tail portion 40 relative to the block member 52** when the block member is in engagement with the stop member.

The longitudinal side wall 28 includes a projection 62 which extends part way across the width of the housing 26, terminating short of the side leg 56 of the block member 52. The projection 62 is situated rearwardly from the transverse section 60 of the tail portion 40 and is provided with a slot 64 which is of sufficient size as to permit free passage of the second longitudinal section **40*b* of the tail portion 40 therethrough. A second compression member comprising a coil spring 66 is situated within the housing 26 between a front surface of the projection 62 and a rear surface of the transverse section 60 of the tail portion 40. The coil spring 66 urges the primary latch bolt mechanism 36 in a forward direction whereby the front section of the head portion 38 including the bevelled surface 42 extends outwardly from the open end 44 of the housing 26, as best seen in FIG. 1. The force exerted by coil spring 66 increases as the distance between transverse section 60 and projection 62 decreases due to rearward movement of the primary latch bolt mechanism 36. Thus, upon engagement of the bevelled surface 42 with a strike, thereby initiating rearward movement of the mechanism 36, the force exerted by coil spring 66 increases. The stiffness of coil spring 58 exceeds the stiffness of coil spring 66 such that the force of spring 66 does not result in movement of block member 52 or auxiliary bolt 46**.

The door latch mechanism of the embodiment illustrated in the drawings is provided with two handles 68 and 70 which are supported in position on either side of the door 24 by shafts 72 and 74. Shafts 72 and 74 extend through transverse openings **76*a* and 78*a* respectively in the door as well as through aligned openings 76*b* and 78*b* in side walls 28 and 30, the openings adapted to permit unimpeded sliding movement of shaft 72 and rotational movement of shaft 74 relative to the door. The shaft 72 is provided with a stop member 80 which is slidably mounted thereon within the housing 26. A third compression member comprising a coil spring 82 is also mounted on the shaft 72 with one end of coil spring 82 engaging side wall 28 and the opposite end engaging a vertical side surface 81a of the stop member 80, the coil spring 82 biasing stop member 80 against the side wall 30 of the housing 26. In this position, a vertical front surface 81b of the stop member 80 engages a rear surface of side leg 56 of the block member 52. A collar 84 is secured to shaft 72 with one end of the collar engaging handle 70 and the opposite end of the collar engaging vertical side surface 81*c* of stop member 80, the function of which will be described below. The bottom wall 32 of the housing 26 is provided with a projection 86 which is adapted to counteract side thrust of the stop member 80 when coil spring 58 is compressed, thereby minimizing the strain put on shaft 72. Further, stop member 80 is loosely mounted on shaft 72 in order to facilitate assembly of the door latch mechanism, with a lower surface of stop member 80 slidingly engaging bottom wall 32** in order to restrict rotational movement of the stop member.

Figure 8:
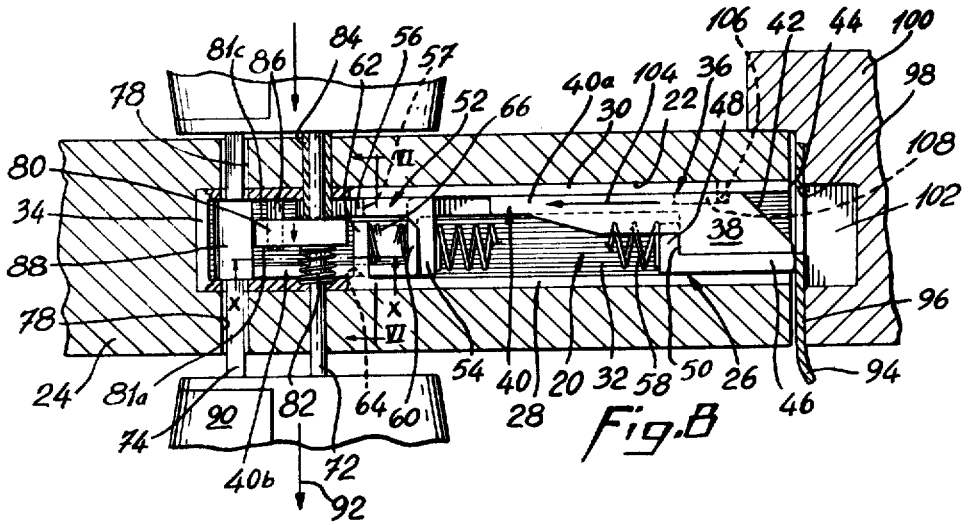
FIG. 8 is a plan view of the door latch mechanism in position to permit opening of the door.
Figure 9:
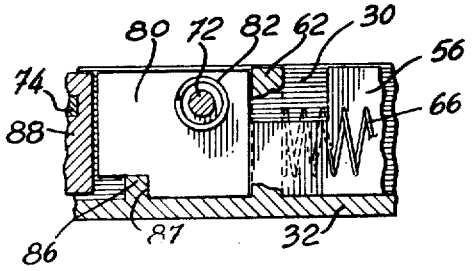
FIG. 9 is a vertical cross-section taken through the housing along the line IX—IX of FIG. 1.
Figure 10:
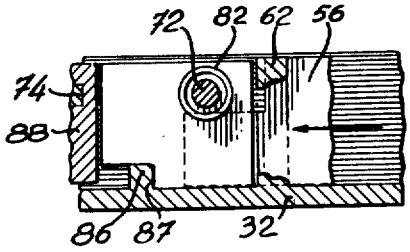
FIG. 10 is a vertical cross-section of the housing taken along the line X—X of FIG. 8.

Shaft 74 is of square cross-section and has a lock member 88 slidably mounted thereon within the housing 26. In the embodiment shown in the drawings, opposite ends of the shaft 74 are provided with lock actuators 90 which are rigidly secured to the shaft. Pivotal movement of either actuator 90 initiates rotation of the shaft 74 and lock member 88, whereby the latter is pivoted forwardly so as to lie against vertical side surface **81*a* of stop member 80, as best illustrated in FIGS. 2 and 2*a***. In this position, movement of either handle 68 or handle 70 in the direction indicated by arrows 92 in FIG. 8 is prevented. In addition, as shown in FIGS. 2 and 2*a*, engagement of the end of second longitudinal section 40*b* with lock member 88, in the event that lock actuator 90 is actuated before the door is closed, will pivot lock member 88 out of engagement with stop member 80, thereby preventing accidental locking of the door latch mechanism.

As seen in FIGS. 1, 1*a*, 7 and 8, primary latch bolt mechanism 36 is retained in housing 26 by a retainer member 106 which is situated in a cooperating opening in longitudinal side wall 30, an inner end of member 106 engaging an elongated slot 108 in a side surface of bolt mechanism 36. In addition, when door 24 is open, retainer member 106 engages a rear end of slot 108, whereby coil spring 66 is compressed slightly. This slight compression ensures a tight assembly.

In the operation of the door latch mechanism, FIG. 1 illustrates the position of the components before the door is closed. In this position, the head portion 38 of the latch bolt mechanism 36 and the forward section of the auxiliary 46 extend outwardly from the open end 44 of the housing 26. As seen in FIG. 1, the auxiliary bolt 46 extends outwardly slightly further than head portion 38 of the primary latch bolt mechanism. As a result, when door 24 is being opened, as shown in FIG. 8, head portion 38 will enter housing 26 a sufficient distance before engaging end projection 48 that head portion 38 will be clear of the strike 96. In the position shown in FIG. 1, coil springs 58 and 82 are in their fully extended positions and coil spring 66 is compressed slightly due to engagement between retainer member 106 and the rear end of slot 108, with coil spring 58 biasing the auxiliary bolt 46 against the head portion 38 and coil spring 66 biasing the primary latch bolt mechanism 36 in a forward direction, while coil spring 82 retains the stop member 80 against the longitudinal side wall 30 of the housing 26. As the door is closed, the bevelled surface 42 of the head portion 38 engages a bent portion 94 of a strike 96 which is mounted on a door frame 100 adjacent the door lock mechanism 20. The strike 96 includes a cooperating opening 98, the opening 98 being so sized as to be adapted to receive only the head portion 38 therethrough. The door frame 100 on which the strike 96 is mounted includes a slot 102 into which the head portion 38 projects when the door is closed.

Figure 7:
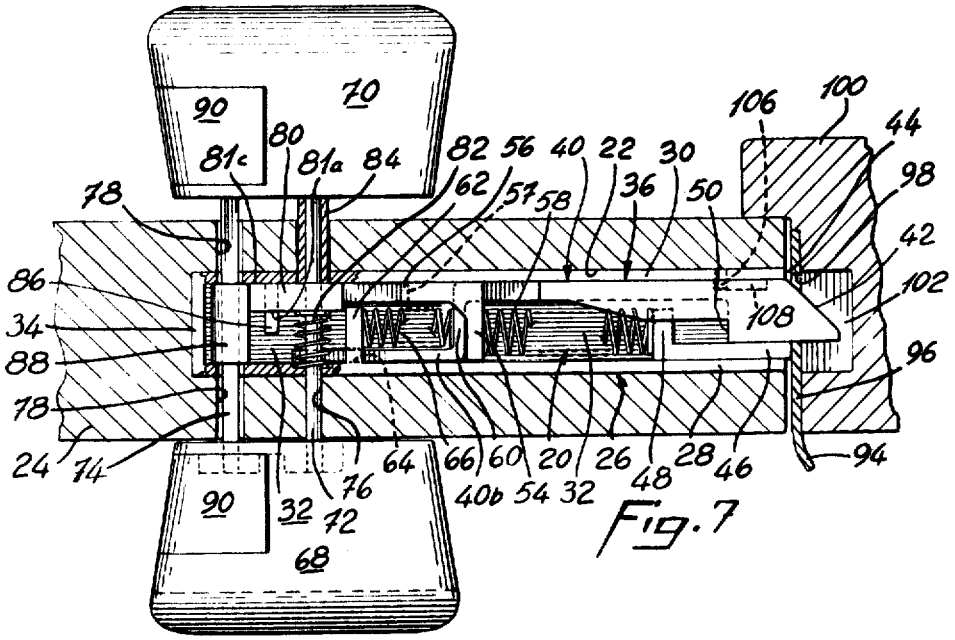
FIG. 7 is a plan view of the door latch mechanism of FIG. 1 with the latch bolt mechanism in engagement with a cooperating opening in a strike.

As the bevelled surface 42 engages the bent portion 94 of the strike 96, both the primary latch bolt mechanism 36 together with auxiliary bolt 46 are urged in a rearward direction, to a position as shown in FIG. 1*a*. When the door is fully closed, the head portion 38 projects through the opening 98 in the strike while the outer end of the auxiliary bolt 46 bears against an outer surface of the strike 96, as best illustrated in FIG. 7. In this position, coil spring 58 is compressed, thereby urging block member 52 rearwardly until the rear surface of side leg 56 engages the vertical front surface 81b of stop member 80. The distance from the rear end of side leg 56 to the vertical front surface of stop member 80 when the door is open is considerably less than the distance which the head portion 38 and auxiliary bolt 46 move inwardly during engagement with the strike 96. This additional movement of the auxiliary bolt 46 results in compression of coil spring 58 which engages the stationary block member 52, while the additional movement of the latch bolt mechanism 36 results in the transverse section 60 of tail portion 40 being moved out of engagement with front leg 54 of the block member 52. As seen in FIG. 1*a*, this rearward movement of transverse section 60 results in further compression of coil spring 66. As a result, when the head portion 38 is aligned with opening 98 in the strike 96, the force generated by compressed coil spring 66 urges the latch bolt mechanism forwardly such that the head portion 38 is projected into the opening 98. The distance which the head portion 38 advances into the opening 98 is limited by engagement of the transverse section 60 with the front leg 54 of the block member 52 which is held in position by coil spring 58. As noted above, the stiffness of spring 58 exceeds the stiffness of coil spring 66, such that forward movement of the latch bolt mechanism is stopped by the force applied by the coil spring 58 against the front face of front leg 54. In this position, either actuator 90 can be operated to lock the head portion against the stop member 80, as described previously.

Figure 6:
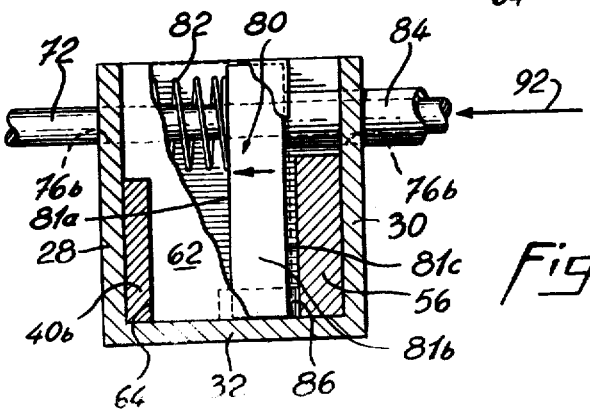
FIG. 6 is a vertical cross-section of the housing taken along the line VI—VI of FIG. 8.

In order to disengage the head portion 38 from the opening 98 and thereby open the door, it is necessary to apply a force to either handle in the direction of arrow 92 illustrated in FIGS. 6 and 8, such a force being provided by either pushing handle 70 or pulling handle 68. Upon application of the force, the stop member 80 is moved out of contact with the rear surface of side leg 56 of the block member 52. As a result, the block member 52 is urged rearwardly by the force of coil spring 58 bearing against the front leg 54 of member 52. Since the force generated by spring 58 exceeds that generated by spring 66, both the block member 52 and primary latch bolt mechanism 36 which engages the block member 52 at transverse section 60 are urged rearwardly, as indicated by arrow 104 in FIG. 8. At the same time, the head portion 38 is disengaged from the opening 98, thereby permitting opening of the door 24.

I claim:

1. A door latch mechanism comprising:

a housing adapted to be mounted in a door, the housing having an open end;

a primary latch bolt mechanism slidably mounted within the housing, the primary latch bolt mechanism having a head portion and an integral tail portion, a forward section of the head portion situated at the open end of the housing projecting outwardly through the open end of the housing and adapted to engage a cooperating opening in a strike;

an auxiliary bolt slidably mounted within the housing at the open end thereof and situated adjacent to and engaging the head portion of the primary latch bolt mechanism, a forward portion of the auxiliary bolt projecting outwardly through the open end of the housing, the forward portion of the auxiliary bolt adapted to be urged rearwardly upon rearward movement of the head portion of the primary latch bolt mechanism;

a block member slidably mounted within the housing and situated rearwardly from the auxiliary bolt and head portion;

a first compression member mounted within the housing and engaging the block member and auxiliary bolt so as to bias the auxiliary bolt away from the block member;

a second compression member mounted within the housing, the second compression member engaging the tail portion of the primary latch bolt mechanism and projection means rigidly mounted within the housing, the second compression member biasing the forward section of the head portion outwardly through the open end of the housing while biasing the tail portion of the primary latch bolt mechanism against the block member;

a stop member mounted within the housing on a shaft extending transversely through the housing;

at least one handle rigidly mounted on the shaft exterior to the housing, the at least one handle adapted to permit the transverse shaft to be moved in a longitudinal direction thereof, whereby the stop member is advanced out of engagement with the block member;

the primary latch bolt mechanism and auxiliary bolt adapted to be urged rearwardly upon engagement of the forward section of the head portion of the bolt mechanism with a strike, thereby compressing the first and second compression members, a force generated by the first compression member exceeding a force generated by the second compression member, whereby a resultant force is applied to the block member, urging the block member rearwardly into contact with the stop member, the forward section of the head portion engaging a cooperating opening in the strike and being projected into the opening by the second compression member while the strike retains the auxiliary bolt within the housing, the at least one handle adapted to be moved axially whereby the stop member is advanced out of engagement with the block member, whereby the block member and the tail portion of the latch bolt mechanism are urged rearwardly by the first compression member, thereby disengaging the head portion of the door latch mechanism from the cooperating opening in the strike.

2. A door latch mechanism according to claim 1, wherein a third compression member is mounted between the housing and the stop member on the transversely extending shaft, the third compression member urging the stop member into a position in which the stop member engages the block member, thereby retaining a forward section of the head portion in contact with the cooperating opening in the strike.

3. A door latch mechanism according to claim 1, wherein a second transverse shaft extends through the housing, the second transverse shaft supporting a lock member which is rotatable with the second transverse shaft, the second transverse shaft also provided with at least one lock actuator mounted thereon exterior to the housing, whereby rotation of the lock actuator rotates the lock member on the second transverse shaft into engagement with the stop member on the first transverse shaft when the stop member is in a position in which the block member is adapted to engage the stop member, the lock member thereby preventing disengagement of the stop member from the block member and retaining the head portion of the primary latch bolt mechanism in contact with a cooperating opening in a strike.

4. A door latch mechanism according to claim 2, wherein the stop member is slidably mounted on the transversely extending shaft so as to facilitate assembly of the latch mechanism, the transversely extending shaft being provided with engagement means adapted to engage the stop member and urge the latter out of engagement with the block member when the at least one handle is moved axially, thereby disengaging the forward section of the head portion from the cooperating opening in the strike.

5. A door latch mechanism according to claim 4, wherein the engagement means comprises a collar rigidly mounted on the transversely extending shaft.

6. A door latch mechanism according to claim 1, wherein the first and second compression members comprise coil springs.

7. A door latch mechanism according to claim 2, wherein the third compression member comprises a coil spring.

8. A door latch mechanism according to claim 1, wherein an outer end of the auxiliary bolt projects out of the housing beyond an outer end of the head portion of the primary latch bolt mechanism whereby the head portion of the primary latch bolt mechanism, upon advancing the stop member out of engagement with the block member, will be advanced into the housing a sufficient distance to clear the opening in the strike before a rear surface of the head portion engages a cooperating shoulder of the auxiliary bolt.

9. A door latch mechanism according to claim 3, wherein the tail portion of the primary latch bolt mechanism is adapted to engage the lock member so as to disengage the lock member from the stop member, thereby preventing accidental locking of the door latch mechanism before closing of a door.

* * * * *